US005601663A

United States Patent [19]

Rungta et al.

[11] Patent Number: 5,601,663

[45] Date of Patent: Feb. 11, 1997

[54] PROCESS FOR FORMING A BLACK OXIDE ON ALUMINUM ALLOYS AND A SOLUTION THEREFOR

[75] Inventors: Ravi Rungta, East Amherst; Robert R. Ahrens, Angola; Mingguang Zhu, Buffalo, all of N.Y.

[73] Assignee: General Motors Corporation, Detroit, Mich.

[21] Appl. No.: 605,405

[22] Filed: Feb. 22, 1996

[51] Int. Cl.[6] ..... C23F 7/00

[52] U.S. Cl. ..... 148/271; 148/274

[58] Field of Search ..... 148/274, 275, 148/271

[56] References Cited

U.S. PATENT DOCUMENTS 4,354,881 10/1982 Tanikawa ..... 148/274

4,647,392 3/1987 Darden et al. ..... 252/75

*Primary Examiner*—Sam Silverberg

*Attorney, Agent, or Firm*—George A. Grove

[57] ABSTRACT

A process for producing a black oxide coating on an aluminum or aluminum alloy component in which the process entails a single treatment step with a novel solution to rapidly produce the desired black oxide coating. The process includes cleaning the surface to be coated and then, without first undergoing anodization, treating the surface with a solution that develops a black oxide on the surface. The reactive component of the solution comprises distilled water containing chlorides, sulfates and bicarbonates of sodium salts. The remainder of the solution includes a catalyst and a substance for maintaining the pH of the solution at a level sufficient to promote the reaction between the surface of the aluminum alloy and the reactive constituents.

14 Claims, No Drawings

PROCESS FOR FORMING A BLACK OXIDE ON ALUMINUM ALLOYS AND A SOLUTION THEREFOR

The present invention generally relates to processes for forming a black oxide on the surface of an aluminum alloy component or assembly, such as a heat exchanger. More particularly, this invention relates to a chemical process that produces a black oxide layer on an aluminum alloy surface without first requiring anodizing of the aluminum alloy surface.

BACKGROUND OF THE INVENTION

Condensers and radiator heat exchangers for automotive applications are often painted black in order to reduce their metallic visibility through the front grill of an automobile. While various paints and painting processes have been developed to enhance the quality of the paint and achieve a more efficient and cost effective painting process, a significant disadvantage is the volatile emissions that are inherent with the use of paints. In addition, a significant amount of paint waste is typical in any painting process. Accordingly, alternatives to painting such components would be desirable.

A black oxide layer can typically be formed on aluminum and its alloys by first anodizing the metal surface to form an aluminum oxide (alumina) layer. This anodic oxidation process is performed in an electrolyte solution that typically contains sulfuric, chromic or oxalic acids, and converts the aluminum at the metal surface to alumina. The alumina layer must then be treated with an appropriate solution to generate the desired black coloration. While black oxide coatings are widely used in various applications, they generally have not been applied to heat exchanger assemblies due to the requirement for the anodizing process. In particular, anodizing of a heat exchanger is expensive due to the heat exchanger's large surface area. Furthermore, a uniform anodized oxide layer cannot be easily formed on a heat exchanger due to its compactness.

To overcome the above, various solutions have been suggested in the prior art to blacken an alumina layer on the surface of an aluminum alloy without the requirement for an anodization step. One such solution has been a mixture of copper nitrate and potassium permanganate. However, desirable results have not been readily obtainable with this solution, and the presence of copper in this solution is detrimental to the corrosion resistance of aluminum alloys, particularly those of the type used to form heat exchangers.

In view of the above, it is apparent that an alternative to painting a heat exchanger would be desirable. However, it is also apparent that a black oxide coating capable of providing the desired black coloration for automotive heat exchangers has not been achieved to date, as a result of required additional processing steps or the use of solutions that are not compatible with large-scale production practices.

SUMMARY OF THE INVENTION

It is an object of this invention to provide a process for developing a black oxide coating on an aluminum-containing component.

It is another object of this invention that such a process eliminates the requirement for anodizing the component, so as to yield a process that is amenable to mass production practices.

It is a further object of this invention that such a process employs a novel treatment solution that develops the desired black oxide coating under conditions readily attainable in production.

In accordance with a preferred embodiment of this invention, these and other objects and advantages are accomplished as follows.

According to the present invention, there is provided a process capable of producing a black oxide coating on an aluminum or aluminum alloy component, in which the process entails a single treatment step with a novel solution to rapidly produce the desired black oxide coating. The process includes cleaning the surface of the aluminum alloy so as to remove oils and other contaminants that would otherwise hinder formation of oxide on the surface. Then, and without first undergoing anodization, the surface of the aluminum alloy is treated with a solution that develops a black oxide. The reactive component of the solution comprises distilled water containing chlorides, sulfates and bicarbonates of sodium salts. The remainder of the solution includes a catalyst and a substance for maintaining the pH of the solution at a level that enables the reaction between the surface of the aluminum alloy and the solution. In accordance with this invention, a proper pH for the solution is critical, while the temperature of the solution is preferably as high as practicably possible while remaining below the boiling point of the solution. Treatment is continued for a time sufficient to develop a suitable thickness for the oxide layer, after which the surface of the aluminum alloy is preferably rinsed with distilled water and then dried with air at approximately room temperature.

According to one embodiment of the invention, the catalyst comprises tolyltriazole, sebacic acid, hexanoic acid, and the treatment step is carried out at a pH of about 7.5 to about 8.5 and at a temperature of about 80° C. to about 90° C. For this solution, a carrier such as ethylene glycol is preferably included for hexanoic acid. In addition, the solution may further include sodium silicate as a reactive component. According to a second embodiment of this invention, the catalyst comprises sodium phosphate dibasic, sodium benzoate and sodium molybdate dihydrate, and the treatment step is carried out at a pH of about 8.0 to about 9.0 at a temperature of about 80° C. to about 90° C.

From the above, it is apparent that the process of this invention entails a single treatment step that simultaneously forms a desired oxide layer and produces the desired black coloration for the oxide layer. Therefore, this process completely eliminates the prior art practice of first anodizing the aluminum surface, followed by a separate treatment for producing the black color on the oxide layer generated by anodization. Accordingly, the process of this invention is highly suited for use in mass production, such as in the production of automotive heat exchangers having a dark or black coloration in order to render them less noticeable.

Other objects and advantages of this invention will be better appreciated from the following detailed description.

DESCRIPTION OF PREFERRED EMBODIMENTS

The process of this invention forms a black oxide layer on a surface of an aluminum or aluminum alloy, in which the black oxide layer is formed during a single treatment step using either one of two novel solutions. While each of the solutions employs compounds and chemicals known in the heat exchanger industry, the ability of these compounds and chemicals in combination to form a black oxide layer was unknown and unexpected. Furthermore, while the process of this invention is particularly well suited for use in the manufacture of heat exchangers for the automotive industry, those skilled in the art will appreciate that this process is equally applicable to various other applications in which a black oxide layer is desired on a surface of an aluminum-containing component, such as a solar energy collector.

The two solutions of this invention share common reactive ingredients, with the remaining ingredients serving primarily as catalysts that are not consumed during the reaction, or serving to maintain the pH of the solution at an appropriate level, or serving as an inert carrier for another ingredient of the solution. The common reactive ingredients of the solutions are chlorides, sulfates and bicarbonates present in the solution as sodium salts dissolved in distilled water. Suitable levels of these salts are provided through the use of a solution defined and identified in ASTM Standard D1384-87 as ASTM water, in which 100 parts per million (ppm) each of sodium chloride (NaCl), sodium sulfate ($Na_2SO_4$) and sodium bicarbonate ($NaHCO_3$) are dissolved in distilled water, though it is foreseeable that greater or lesser amounts of these salts could be employed. In the presence of either one of two combinations of catalysts taught by this invention, the above salts have been surprisingly found to produce a desirable black oxide layer on an aluminum or aluminum alloy surface if properly maintained at a suitable temperature and pH level.

While the two solutions of this invention differ considerably in their remaining ingredients, they share in common the phenomenon of producing a black aluminum oxide through a reaction that is not well understood. Those skilled in the art are aware that an oxide layer is generated on aluminum when immersed in hot distilled water. However, such an oxide layer is colorless. If sodium chloride, sulfates and bicarbonate are dissolved in the hot distilled water, a gold-colored oxide will form. However, in accordance with this invention, it has been determined that a black oxide will develop only through the presence of the disclosed additional ingredients in conjunction with these sodium salts. The additional ingredients are not significantly consumed during the reaction, but instead appear to serve as catalysts. Consequently, use of these solutions does not require significant additions of the catalytic components, but instead require only that the pH of the solutions be maintained at an appropriate level to continue the reaction.

According to the invention, a first of the two catalyst combinations is composed of tolyltriazole, sebacic acid and hexanoic acid. For this solution, a carrier such as ethylene glycol is preferably included for hexanoic acid, as this acid is not soluble in water. While the use of tolyltriazole, sebacic acid and 2-ethylhexanoic acid in combination are disclosed in U.S. Pat. No. 4,647,392 to Darden et al., their use in Darden et al. is completely contrary to their role within the solution of the present invention. In Darden et al., tolyltriazole, sebacic acid and 2-ethylhexanoic acid are used as corrosion inhibitors for internal corrosion protection of a radiator. Because Darden et al. teach the use of ethylene glycol as the coolant, corrosion protection requires that the needed concentration of tolyltriazole, sebacic acid and hexanoic acid as corrosion inhibitors is maintained in the ethylene glycol through additions of these inhibitors as they are consumed. Furthermore, contaminants such as chlorides and sulfates are not acceptable in a coolant solution because they cause pitting in aluminum alloys, as evidenced by the ASTM water employed herein being described as "corrosive" water in the ASTM standards.

In contrast to Darden et al., the teachings of this invention are that tolyltriazole, sebacic acid and hexanoic acid are required together to facilitate the black oxide process, but do not directly participate in the reaction. As such, these components are not consumed to any significant degree during the reaction, though some depletion can be expected over time. Furthermore, the present invention requires the presence of chlorides and sulfates as primary reactants that produce the desired black oxide coating, which is contrary to corrosion inhibitors of the type taught by Darden et al.

Particularly preferred ranges for the individual ingredients to produce one liter of this solution are as follows:

TABLE I

| | |
|---|---|
| Tolyltriazole | 0.05–0.8 grams |
| Sebacic acid | 0.2–1.5 grams |
| Hexanoic acid | 15–50 milliliters |
| Sodium chloride | 1.6–3.2 grams |
| Sodium sulfate | 1.5–3.0 grams |
| Sodium bicarbonate | 1.4–2.8 grams |
| Sodium silicate | less than 0.2 grams |
| Ethylene glycol | 20–80 milliliters |
| Distilled water | balance |
| Sodium hydroxide | As required to maintain pH of 7.5–8.5 @ 80–90° C. |

As seen from the above, this solution employs sodium hydroxide to maintain the pH of the solution at the appropriate level at a temperature of about 80° C. to about 90° C. for the reaction, though it is foreseeable that other bases could be used. This solution is also shown to include sodium silicate (water glass), which has been found to accelerate the blackening process. Finally, the ASTM water described above has been broken down to provide ranges for its individual constituents. Within the above ranges, a preferred one-liter solution in accordance with this first embodiment of the invention is as follows: about 0.4 grams tolyltriazole, about 0.9 grams sebacic acid, about 35 milliliters hexanoic acid, about 80 milliliters ethylene glycol, about 160 milliliters 110X ASTM water (containing an equivalent of about 2.64 grams sodium chloride, about 2.37 grams sodium sulfate, and about 2.21 grams sodium bicarbonate), and about 670 milliliters distilled water, which is maintained by about 52 milliliters 16.7% sodium hydroxide at a pH of about 8.1 at a temperature of about 80° C. to about 90° C.

In practice, a surface on which a black oxide layer is to be formed is first cleaned to remove any oil or other contaminants that might hinder the formation of the oxide layer. Many cleaning procedures and solutions are known for this purpose, and will not be described in any detail here. After cleaning, the surface is rinsed with tap water and then immersed in the above solution maintained at a temperature of about 80° C. to about 90° C. Treatment durations of about thirty minutes have been found sufficient to produce an acceptable black oxide layer having a thickness of about 500Å, though it is foreseeable that shorter or longer durations could be employed. After treatment, the surface is preferably rinsed with distilled water and then dried with room temperature air.

According to this invention, a second catalyst combination capable of producing a black oxide layer on an aluminum surface is composed of sodium phosphate dibasic ($Na_2HPO_4$), a sodium salt of benzoic acid (sodium benzoate: $C_6H_5COONa$), and sodium molybdate dihydrate ($NaMoO_4.2H_2O$). Similar to tolyltriazole, sebacic acid and hexanoic acid of the first embodiment, sodium phosphate dibasic, sodium benzoate and sodium molybdate dihydrate of this embodiment are known corrosion inhibitors. However, as also discussed in reference to the first embodiment, the individual constituents of this catalyst combination do not serve as corrosion inhibitors here, but instead are required together to facilitate the black oxide process and do not directly participate in the reaction.

Particularly preferred ranges for the individual ingredients to produce a one-liter solution in accordance with this second embodiment of the invention are as follows:

TABLE II

| | |
|---|---|
| Sodium phosphate dibasic | 5–12 grams |
| Sodium benzoate | 5–12 grams |
| Sodium molybdate dihydrate | 0.5–1 gram |
| Sodium chloride | 4.0–6.0 grams |
| Sodium sulfate | 3.5–5.5 grams |
| Sodium bicarbonate | 3.5–5.5 grams |
| Distilled water | balance |
| Sodium hydroxide | As required to maintain pH of 8.0–9.0 @ 80–90° C. |

Again, the above solution employs sodium hydroxide to maintain the pH of the solution at the appropriate level of about 8.0 to about 9.0 for the reaction, though it is foreseeable that another base could be used. In addition, the ASTM water has again been broken down to provide ranges for its individual constituents. Within the above ranges, a preferred one-liter solution in accordance with this second embodiment of the invention is as follows: about 10 grams sodium phosphate dibasic, about 5 grams sodium benzoate, about 0.6 grams sodium molybdate dihydrate, about 300 milliliters ASTM water (containing an equivalent of about 4.95 grams sodium chloride, about 4.44 grams sodium sulfate, and about 4.14 grams sodium bicarbonate), and about 700 milliliters distilled water, which is maintained by the specified amount of sodium hydroxide at a pH of about 8.8 at a temperature of about 80° C. to about 90° C.

The above solution can be used in an essentially identical manner as that described for the solution of the first embodiment. Namely, the surface on which a black oxide layer is to be formed is first cleaned to remove any oil or other contaminants, then rinsed with tap water and subjected to the above solution maintained at a temperature of about 80° C. to about 90° C. for a duration of about thirty minutes. Thereafter, the surface is rinsed with distilled water and then dried with room temperature air.

Surprisingly, treatments from using the above solutions have produced nearly identical results. The thickness of a black oxide layer formed using either of these solutions will vary with the duration of treatment, with thicknesses of up to about 500Å being achievable within the thirty minute period indicated. Notably, treatments of various aluminum alloys have been successful with the solutions of this invention, including aluminum-manganese alloys (e.g., AA 3102), aluminum-silicon alloys (e.g., AA 4047), and aluminum-zinc alloys (e.g., AA 7072).

From the above, it is apparent that a significant advantage of the process of this invention is that a single treatment step is capable of simultaneously forming a desired oxide layer and producing the desired black coloration for the oxide layer. As such, the process of this invention completely eliminates the prior art practice of first anodizing the aluminum surface, followed by a separate treatment for producing the black coloration in the oxide layer. Accordingly, this process is more efficient and economical than prior art methods for producing black oxide coatings, and is therefore highly suited for use in mass production, such as in the production of automotive heat exchangers whose surfaces are desired to be black in order to render them less noticeable.

While this invention has been described in terms of preferred embodiments, it is apparent that other forms could be adopted by one skilled in the art. For example, it is foreseeable that the process could be modified to include additional steps or treatments, and the solutions could be modified to employ different amounts of the specified constituents, or to include additional reactive and/or catalytic constituents. Accordingly, the scope of this invention is to be limited only by the following claims.

What is claimed is:

1. A solution for forming a black oxide on a surface of an aluminum-containing metal, the solution comprising, per liter, about 0.05 to about 0.8 grams of tolyltriazole, about 0.2 to about 1.5 grams of sebacic acid, about 15 to about 50 milliliters of hexanoic acid, distilled water, about 1.6 to about 3.2 grams of sodium chloride, about 1.5 to about 3.0 grams of sodium sulfate and about 1.4 to about 2.8 grams of sodium bicarbonate, and a substance for maintaining the pH of the solution at about 7.5 to about 8.5 at a temperature of about 80° C. to about 90° C.

2. A solution as recited in claim 1 further comprising a carrier for hexanoic acid.

3. A solution as recited in claim 1 wherein the substance for maintaining the pH of the solution is sodium hydroxide.

4. A solution as recited in claim 1 further comprising sodium silicate.

5. A solution as recited in claim 1 wherein tolyltriazole, sebacic acid, and hexanoic acid are catalysts.

6. A solution as recited in claim 1 wherein the solution comprises, per liter, about 0.05 to about 0.8 grams of tolyltriazole, about 0.2 to about 1.5 grams of sebacic acid, about 15 to about 50 milliliters of hexanoic acid, about 1.6 to about 3.2 grams of sodium chloride, about 1.5 to about 3.0 grams of sodium sulfate, about 1.4 to about 2.8 grams of sodium bicarbonate, up to about 0.2 grams of sodium silicate, about 20 to about 80 milliliters of ethylene glycol, and the balance being distilled water and a sufficient amount of sodium hydroxide to maintain the pH of the solution at about 7.5 to about 8.5 at a temperature of about 80° C. to about 90° C.

7. A process for forming a black oxide on a surface of an aluminum-containing metal, the process comprising the steps of:

cleaning the surface of the aluminum-containing metal so as to remove oils and other contaminants that would otherwise hinder formation of the black oxide on the surface; and without first anodizing the surface, treating the surface of the aluminum-containing metal to a solution that develops the black oxide, the solution comprising a catalyst, distilled water containing chlorides, sulfates and bicarbonates of sodium salts, and a substance for maintaining the pH of the solution at a level sufficient to promote a reaction between the surface of the aluminum-containing metal and the chlorides, sulfates and bicarbonates of sodium salts at a temperature of about 80° C. to about 90° C., wherein the catalyst comprises per liter of said solution about 0.05 to about 0.8 grams of tolytriazole, about 0.2 to about 1.5 grams of sebacic acid, and about 15 to about 50 milliliters of hexanoic acid.

8. A process as recited in claim 7 wherein the treating step is carried out at a pH of about 7.5 to about 8.5.

9. A process as recited in claim 8 further comprising a carrier for hexanoic acid.

10. A process as recited in claim 8 wherein the substance for maintaining the pH of the solution is sodium hydroxide.

11. A process as recited in claim 8 wherein the solution further comprises sodium silicate.

12. A process as recited in claim 8 wherein tolyltriazole, sebacic acid, and hexanoic acid are not substantially consumed during the treating step.

13. A process as recited in claim 8 wherein the solution comprises, per liter, about 0.05 to about 0.8 grams of tolyltriazole, about 0.2 to about 1.5 grams of sebacic acid, about 15 to about 50 milliliters of hexanoic acid, about 1.6 to about 3.2 grams of sodium chloride, about 1.5 to about 3.0 grams of sodium sulfate, about 1.4 to about 2.8 grams of sodium bicarbonate, up to about 0.2 gram sodium silicate, about 20 to about 80 milliliters of ethylene glycol, and the balance being distilled water and a sufficient amount of sodium hydroxide to maintain the pH of the solution at about 7.5 to about 8.5 at a temperature of about 80° C. to about 90° C.

14. A process as recited in claim 10 further comprising the steps of rinsing the surface with distilled water and then drying the surface with air at approximately room temperature following the treating step.

* * * * *